US008217283B2

(12) United States Patent
Arataki et al.

(10) Patent No.: US 8,217,283 B2
(45) Date of Patent: Jul. 10, 2012

(54) TRIGGER SWITCH

(75) Inventors: Akihiro Arataki, Kurayoshi (JP); Masafumi Kodani, Tottori-ken (JP); Minoru Kobayashi, Moriyama (JP); Koji Omori, Takatsuki (JP); Yoshiyuki Baba, Hikone (JP)

(73) Assignee: OMRON Corporation, Kyoto (JP)

( * ) Notice: Subject to any disclaimer, the term of this patent is extended or adjusted under 35 U.S.C. 154(b) by 423 days.

(21) Appl. No.: 12/505,199

(22) Filed: Jul. 17, 2009

(65) Prior Publication Data

US 2010/0018847 A1 Jan. 28, 2010

(30) Foreign Application Priority Data

Jul. 24, 2008 (JP) ..... 2008-191209

(51) Int. Cl.
*H01H 9/28* (2006.01)

(52) U.S. Cl. ..... 200/43.17

(58) Field of Classification Search .... 200/43.16–43.19, 200/522, 318, 318.1, 344
See application file for complete search history.

(56) References Cited

U.S. PATENT DOCUMENTS

| | | | | |
|---|---|---|---|---|
| 3,746,813 | A * | 7/1973 | Brown | 200/43.17 |
| 4,219,714 | A * | 8/1980 | Suzuki et al. | 200/43.17 |
| 6,958,455 | B1 * | 10/2005 | Lui | 200/43.17 |
| 7,449,651 | B2 * | 11/2008 | Lin | 200/344 |

FOREIGN PATENT DOCUMENTS

| | | | |
|---|---|---|---|
| CN | 1758394 | A | 4/2006 |
| JP | 2004-351546 | A | 12/2004 |

OTHER PUBLICATIONS

Chinese Office Action issued in Chinese Application No. 200910160142.3 dated Aug. 2, 2011 and English translation thereof, 8 pages.

* cited by examiner

*Primary Examiner* — Felix O Figueroa
(74) *Attorney, Agent, or Firm* — Osha Liang LLP

(57) ABSTRACT

A trigger switch has a trigger arranged projected and biased to a front side in a housing, and a lock member projecting from a side of the trigger towards the housing, and being engaged with a lock button projecting to the side from the housing to fix the trigger in a pulled-in state. The lock member is swingably attached to the trigger.

15 Claims, 7 Drawing Sheets

TRIGGER SWITCH

BACKGROUND OF THE INVENTION

1. Technical Field

The present invention relates to a trigger switch.

2. Related Art

Some trigger switches used in an electrical tool has a lock mechanism for maintaining a pulled-in state of a trigger, that is, holding the tool in an operation state. Such a lock mechanism is generally configured to lock projection of the trigger by engaging a lock button arranged on a housing to a lock member extending parallel to a pull-in direction of the trigger from a side of the trigger towards the housing of a trigger switch, as described in Japanese Unexamined Patent Publication No. 2004-351546.

In such a trigger switch, a stress may concentrate at a root of the lock member when impact is applied to the trigger, and the lock member may break.

In particular, in an electrical tool having a shape in which a handle projects out from a main body towards a lower side as with an electric drill, a stress to bend a lower end of the handle towards a front side of the main body tends to act when dropped. Thus, there are many cases where a force for pushing the trigger downward acts on the trigger switch and cracks form at an upper part of the root of the lock member and the trigger.

SUMMARY

The present invention has been devised to solve the problems described above, and an object thereof is to provide a trigger switch in which a lock member does not break.

In order to solve the problems described above, a trigger switch according to the present invention includes: a trigger arranged projected and biased to a front side in a housing; and a lock member projecting from a side of the trigger towards the housing, and being engaged with a lock button projecting to the side from the housing to fix the trigger in a pulled-in state; wherein the lock member is swingably attached to the trigger.

According to such a configuration, the lock member can swing with respect to the trigger even if an external force acts on the trigger in a direction different from a pull-in direction, and thus a stress does not concentrate at the lock member, and the lock member does not break and detach from the trigger.

Moreover, in the trigger switch according to the present invention, the lock member may be multi-axial swingably supported to the trigger.

According to such a configuration, the stress is prevented from concentrating at a specific position of the lock member with respect to distortion in a plurality of directions of the trigger.

Moreover, in the trigger switch according to the present invention, a swing of the lock member may be enabled by play of connection of the lock member and the trigger.

According to such a configuration, a sufficient swinging range can be ensured with a simple configuration, and processing precision of parts is not required.

Moreover, in the trigger switch according to the present invention, one of the lock member or the trigger may have a pair of outward projections projecting in directions opposite to each other, and the other the lock member or the trigger may have a pair of inward projections projecting towards each other to engage the pair of outward projections from an outer side; and one of the lock member or the trigger may have a first regulating portion for regulating a movement towards a side with respect to the other one, and one of the lock member or the trigger may have a second regulating portion for regulating a movement in a relatively opposite direction to the movement regulated by the first regulating portion with respect to the other one.

According to such a configuration, the pair of inward projections and the pair of outward projections engage with each other to prevent the lock member from detaching in the pull-in direction of the trigger and an up and down direction, and the first regulating portion and the second regulating portion prevent detachment of the lock member to the side. The lock member thus can be attached to the trigger so as not to drop.

Moreover, in the trigger switch according to the present invention, one of the lock member or the trigger may have both the first regulating portion and the second regulating portion.

According to such a configuration, the pair of outward projections and the pair of inward projections are formed in a plate-shape, and thus fabrication of a die for resin molding the trigger or the lock member is facilitated.

Moreover, in the trigger switch according to the present invention, positions of the first regulating portion and the second regulating portion may be shifted in an extending direction of the lock member.

According to such a configuration, at least one side of the side of the outward projection and the inward projection is opened, and thus the fabrication of the die for resin molding is facilitated.

Moreover, in the trigger switch according to the present invention, the pair of projections may be arranged in an up and down direction, a projection on an upper side of at least one of the pair of outward projections or the pair of inward projections being longer than a projection on a lower side.

According to such a configuration, an engagement length of the outward projection and the inward projection on the upper side becomes long, and thus the lock member is less likely to drop from the trigger when the external force for pushing down the trigger is acted.

Moreover, in the trigger switch according to the present invention, the projection of at least one of the pair of outward projections or the pair of inward projections may be inclined towards a near side.

According to such a configuration, due to the inclination of the projection, a pressure angle for generating a stress to deform in a direction the pair of outward projections and the pair of inward projections engage with each other is formed when the external force acts to pull out the lock member from the trigger, whereby the lock member is more effectively prevented from dropping.

Moreover, in the trigger switch according to the present invention, the lock member may be formed with the trigger side branched into two, the outward projection or the inward projection being formed at two distal ends of the branch.

According to such a configuration, as the lock member is branched into two, the lock member can be easily elastically deformed to change a spacing between the pair of projections formed at distal ends, and thus assembly is easier.

Therefore, according to the present invention, since the lock member can swing with respect to the trigger, stress is not concentrated at the lock member with the displacement of the trigger when external force acts on the trigger. Thus, the lock member of the trigger switch does not break when, for example, the electrical tool is dropped.

DETAILED DESCRIPTION

Hereinafter, preferred embodiments of the present invention will be described with reference to the drawings.

Figure 1:
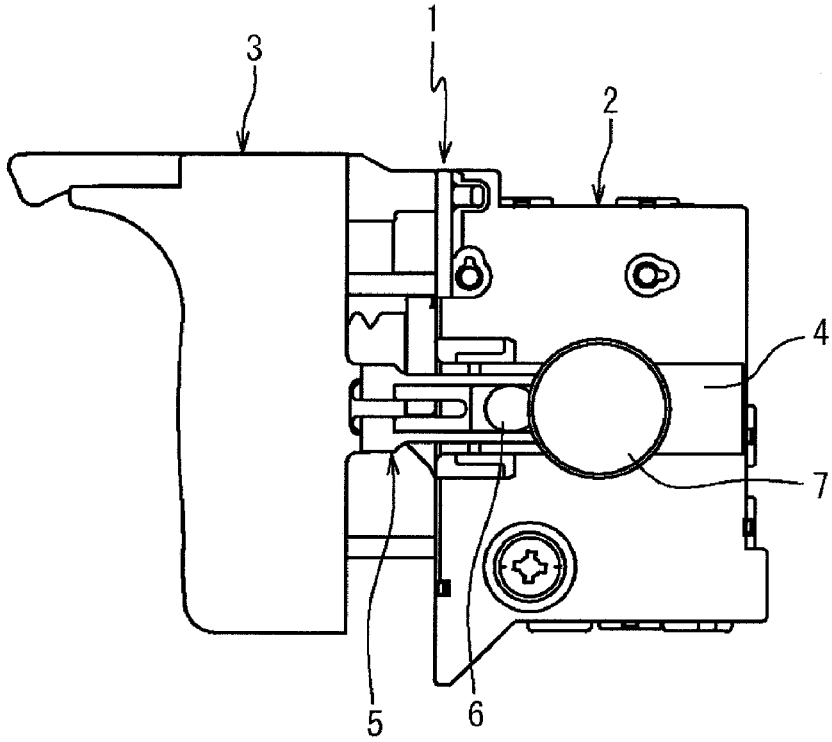
FIG. 1 is a side view of a trigger switch according to a first embodiment of the present invention.

FIG. 1 shows a trigger switch 1 according to a first embodiment of the present invention. The trigger switch 1 includes a substantially box-shaped housing 2 accommodating a contact mechanism (not shown), a trigger 3 arranged projected and biased to a front side of the housing 2, a lock member 5 extending in parallel and in an opposite direction to the projecting direction of the trigger 3 from a side of the trigger 3 and being received by a guide groove 4 formed at a side of the housing 2, and a lock button 7 being arranged biased so as to project to the side from the housing 3 and engaged to a lock hole 6 formed in the lock member 5 by being pushed in towards the housing 3 so as to lock the trigger 3 in a pulled-in state by way of the lock member 5.

Figure 2:
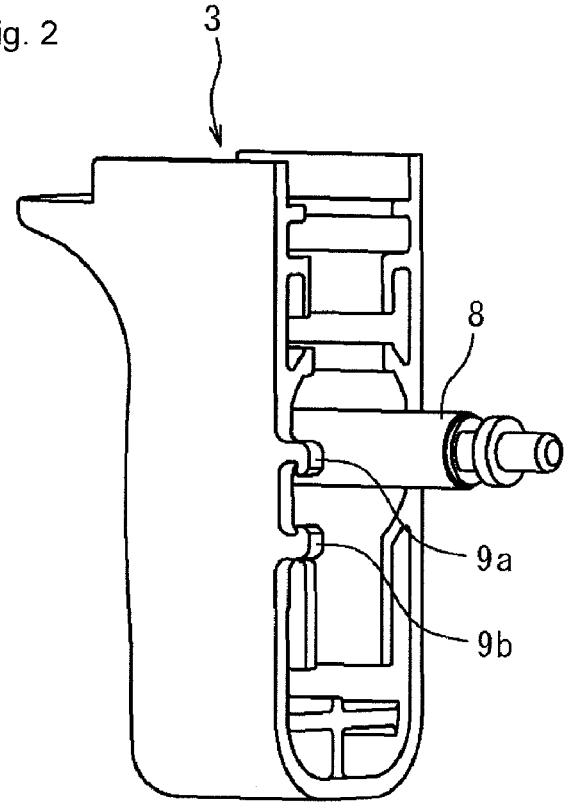
FIG. 2 is a perspective view showing a trigger of the trigger switch in FIG. 1.

FIG. 2 shows a shape of the trigger 3. The trigger 3 includes a shaft part 8, extending to an interior of the housing 2, for driving the contact mechanism in the housing 2. The trigger 3 also includes a pair of projections 9*a*, 9*b* projecting from the side to the housing side and projecting inwardly such that the respective distal ends face each other.

Figure 3:
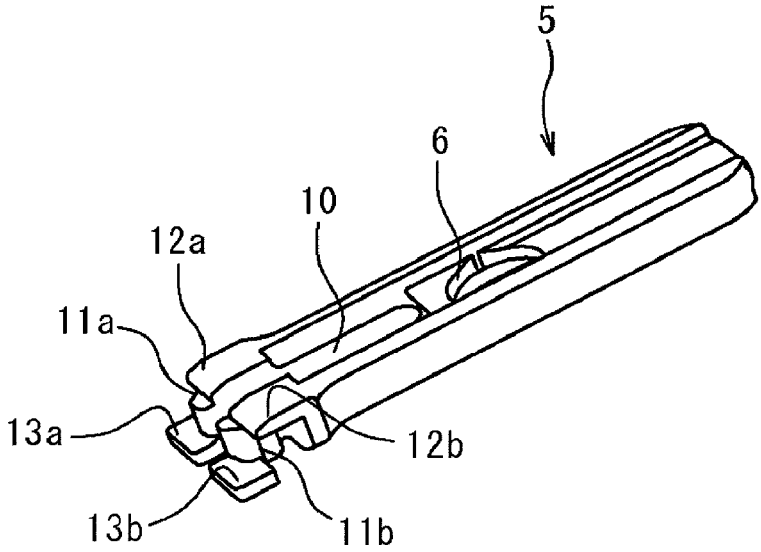
FIG. 3 is a perspective view showing a lock member of the trigger switch in FIG. 1.

Furthermore, FIG. 3 shows a shape of the lock member 5. The lock member 5 has a slit 10 formed on a side that is engaged with the trigger 3, and has a distal end branched into two. A pair of outward projections 11*a*, 11*b* projecting to an outer side is formed at the two distal end portions, respectively, on the trigger 3 side of the lock member 5. The lock member 5 also includes first regulating portions 12*a*, 12*b* that cover the outer side (upper side in the figure) of the housing 2 side (near side) of the outward projections 11*a*, 11*b*, and second regulating portions 13*a*, 13*b* that further project to the trigger 3 side (front side) from the inner side (lower side in the figure) of the outward projections 11*a*, 11*b*.

Figure 4:
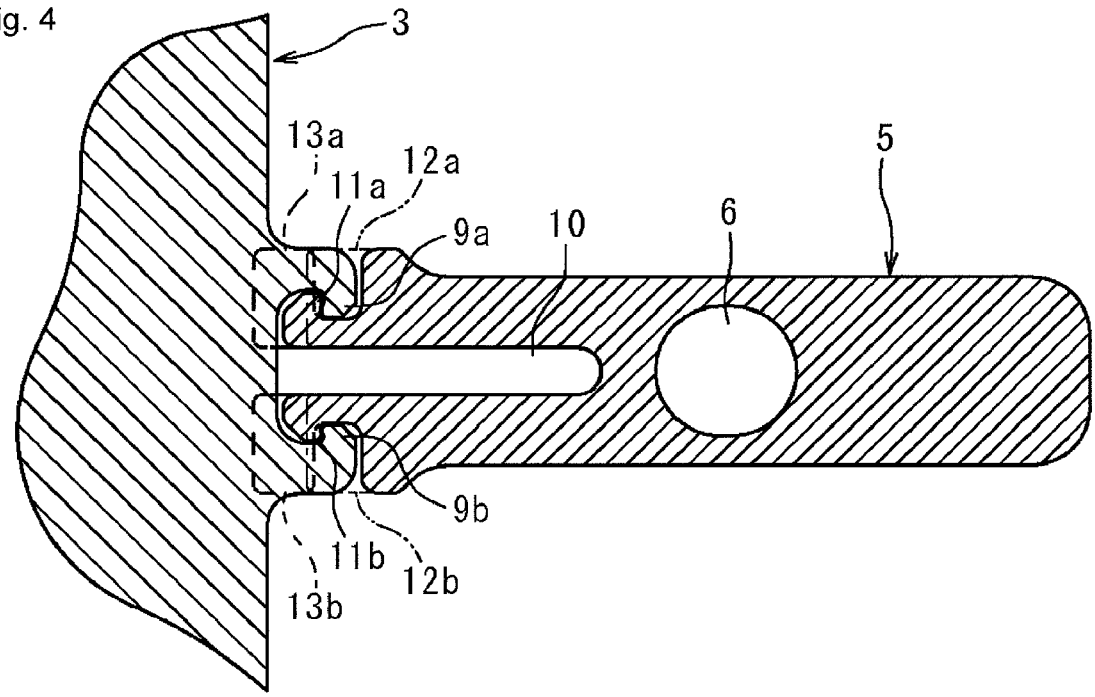
FIG. 4 is a cross-sectional partial side view of the trigger switch in FIG. 1.

FIG. 4 shows an engagement state of the pair of inward projections 9*a*, 9*b* of the trigger 3 and the pair of outward projections 11*a*, 11*b* of the lock member 5. The lock member 5 elastically deforms the two distal end portions so as to approach each other so that the pair of outward projections 11*a*, 11*b* pass the inner side of the pair of inward projections 9*a*, 9*b* of the trigger 3, and engage with respect to each other as shown in the figure, thereby preventing detachment of the trigger 3 and the lock member 5 in the up and down direction and in the front and back direction (pull-in direction of the trigger 3).

It should be noted that the projections 9*a*, 11*a* on an upper side are formed longer than the projections 9*b*, 11*b* on a lower side, and that the projections 9*a*, 9*b* of the trigger 3 are formed to incline towards the near side at the trigger 3 side, and the projections 11*a*, 11*b* are formed to incline towards the near side at the lock member 5 side.

As shown with a chain double-dashed line, the first regulating portions 12*a*, 12*b* cover the outer side (near side in plane of drawing in the figure) of the distal end portions of the inward projections 9*a*, 9*b* of the trigger 3, and the second regulating portions 13*a*, 13*b* at least partially cover the inner side (far side in plane of drawing in the figure) of a root portion of the inward projections 9*a*, 9*b* of the trigger 3.

Figure 5:
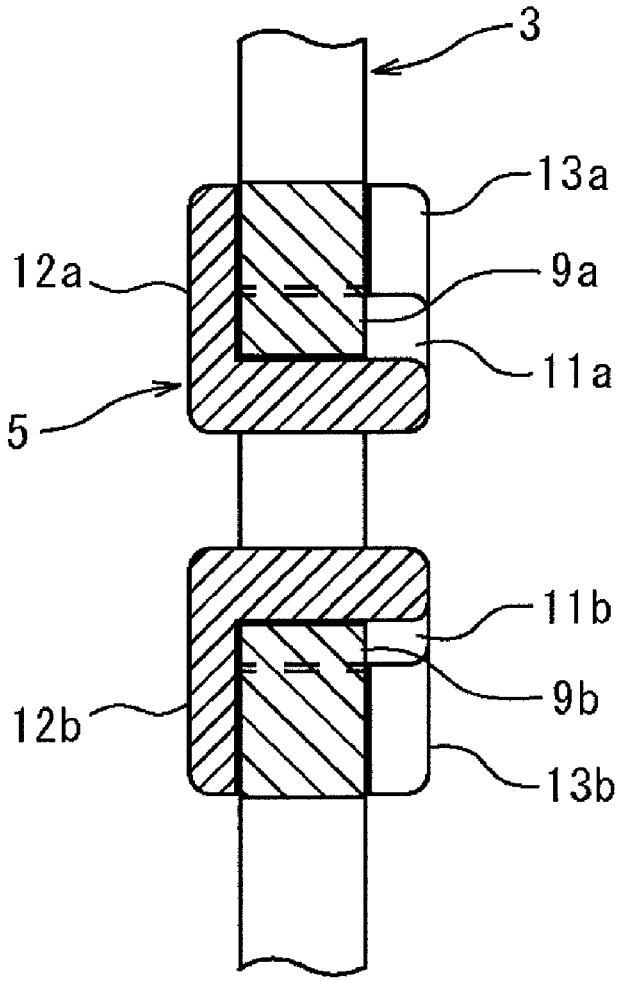
FIG. 5 is a cross-sectional partial rear view of the trigger switch in FIG. 1.

As shown in FIG. 5, the first regulating portions 12*a*, 12*b* of the lock member 5 regulate a movement to the outer side (left side in the figure) of the trigger 3 (relatively, a movement to the inner side of the lock member 5 itself with respect to the trigger 3). The second regulating portions 13*a*, 13*b* of the lock member 5 regulate a movement to the inner side (right side in the figure) of the trigger 3 (relatively, a movement to the outer side of the lock member 5 itself with respect to the trigger 3). In other words, detachment to the side of the trigger switch 1 of the trigger 3 and the lock member 5 is prevented by the first regulating portions 12*a*, 12*b* and the second regulating portions 13*a*, 13*b*.

Figure 6:
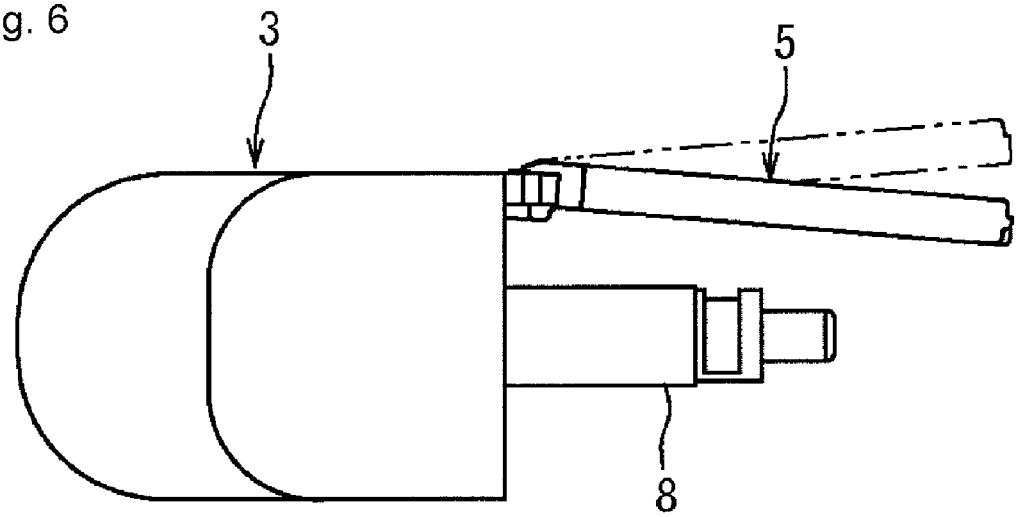
FIG. 6 is a bottom view showing a movable range of the trigger and the lock member of the trigger switch in FIG. 1.
Figure 7:
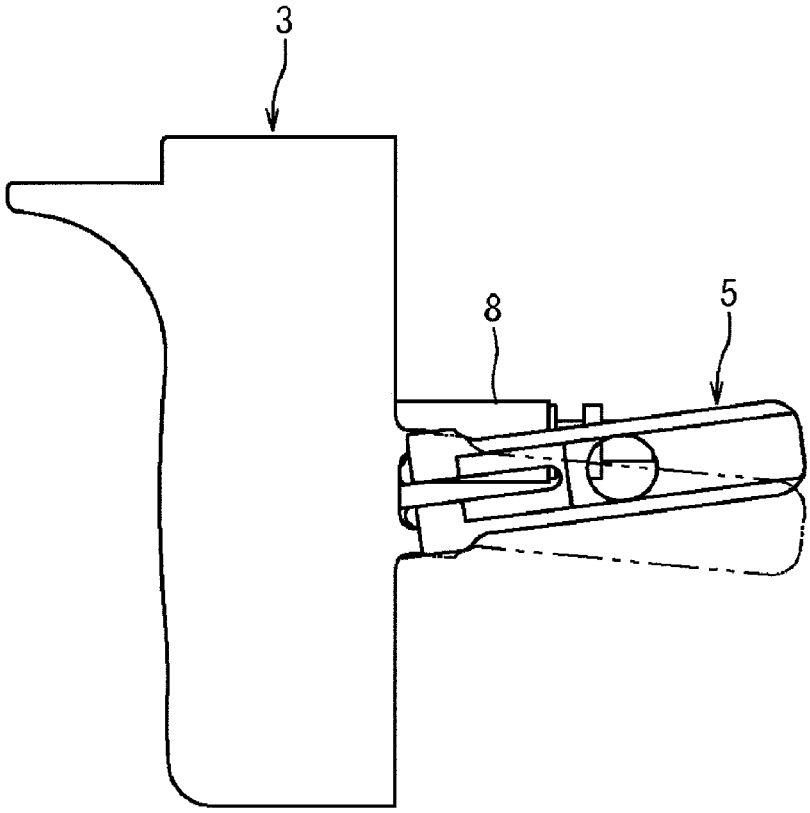
FIG. 7 is a side view showing the movable range of the trigger and the lock member of the trigger switch in FIG. 1.

The engagement of the trigger 3 and the lock member 5 as mentioned above respectively has a slight play, and thus enables a multi-axial swing in the up and down direction and to the side of the lock member 5 with respect to the trigger 3, as shown in FIGS. 6 and 7. A swinging possibility of the lock member 5 enables, when the trigger 3 is displaced within a range of attachment play and its elasticity in the up and down direction and in a left and right direction with respect to the housing 2, a relative change in orientation with respect to the lock member 5 held in the guide groove 4 of the housing 2, and prevents a deformation stress from acting between the trigger 3 and the lock member 5.

Therefore, even if an external force for forcibly displacing the trigger 3 with respect to the housing 2 is acted such as when an electrical tool incorporating the trigger switch 1 is dropped, the lock member 5 does not break and fixation by the lock button 7 of the trigger 3 is not disabled.

If the trigger switch 1 is incorporated in the electrical tool, the external force for pushing down the trigger 3 tends to easily apply. In the present embodiment, the projections 9*a*, 11*a* on the upper side are formed to have the respective engagement length longer than the projections 9*b*, 11*b* on the lower side to further enhance a safety rate in preventing detachment of the lock member 5 from the trigger 3 when the trigger 3 is pushed down. That is, when the trigger 3 is pushed down, sufficient engagement is ensured between the pair of outward projections 9*a*, 9*b* and the pair of inward projections 11*a*, 11*b* and the detachment of the lock member 5 from the trigger 3 is prevented even if an dimensional error of the trigger 3 and the lock member 5, deformation of the lock member 5, and the like occur.

In the present embodiment, the projections 9*a*, 9*b* of the trigger 3 are formed to incline towards the near side at the trigger 3 side and the projections 11*a*, 11*b* of the lock member are formed to incline towards the near side at the lock member 5 side. Thus, when an external force is applied in a direction of separating the trigger 3 and the lock member 5, the inclination of the projections 9*a*, 9*b* and 11*a*, 11*b* becomes a pressure angle, and generates a component force particularly in a direction of elastically deforming the lock member 5 so that the projections 9*a*, 9*b* and 11*a*, 11*b* engage more deeply with each other. The detachment of the lock member 5 from the trigger 3 is thereby prevented.

Figure 8:
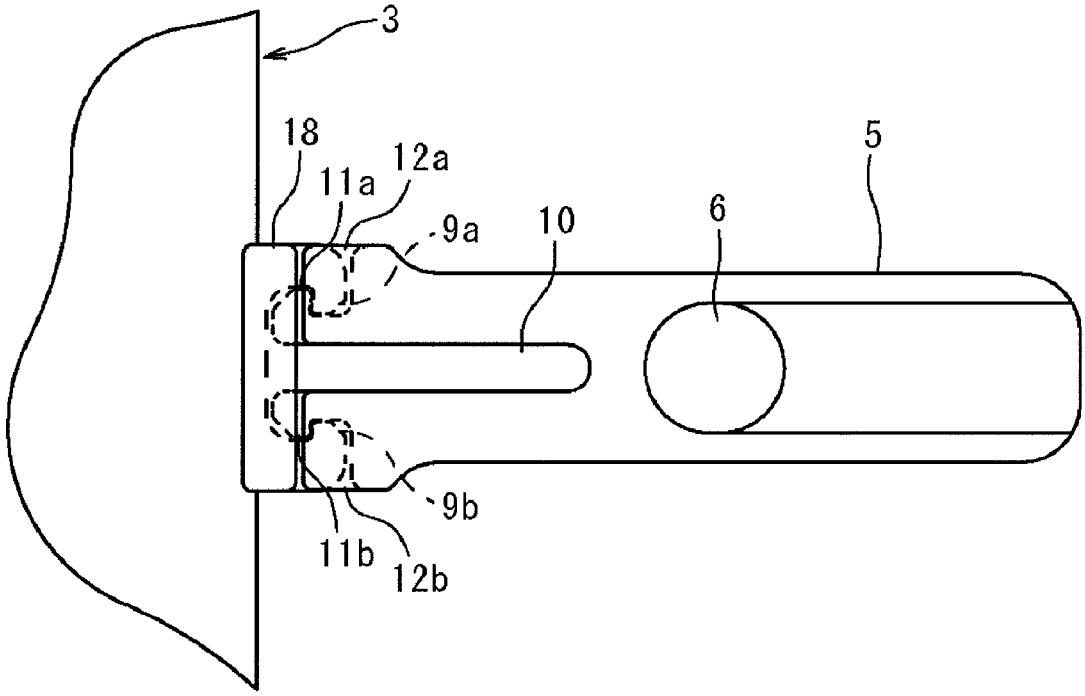
FIG. 8 is a partial side view of a trigger switch according to a second embodiment of the present invention.

FIG. 8 shows the trigger 3 and the lock member 5 of a trigger switch according to a second embodiment of the present invention. In the following description, same reference numerals are denoted for the same components as the components previously described and overlapping descriptions will not be given. In the present embodiment, a second regulating portion 14 that covers the outer side of at least one portion of the outward projections 11*a*, 11*b* of the lock member 5 is formed at the trigger 3. The second regulating portion 14 regulates the movement to the outer side (near side in plane of drawing) of the lock member 5 with respect to the trigger 3 (relatively, movement to the inner side of the trigger 3 itself.

Figure 9:
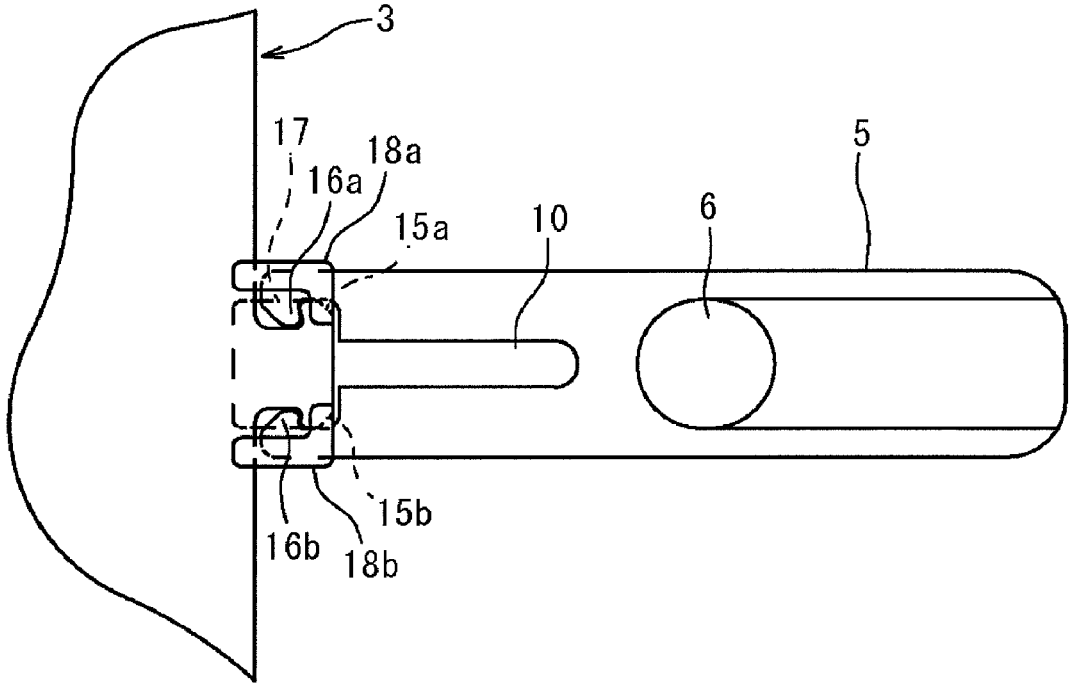
FIG. 9 is a partial side view of a trigger switch according to a third embodiment of the present invention.

FIG. 9 shows the trigger 3 and the lock member 5 of a trigger switch according to a third embodiment of the present invention. In the present embodiment, a pair of outward projections 15*a*, 15*b* is formed at the trigger 3, and a pair of inward projections 16*a*, 16*b* respectively engaged with the pair of outward projections 15*a*, 15*b* is formed at the lock member 5. In the present embodiment, a first regulating portion 17 for regulating the movement to the inner side (far side in plane of drawing) of the lock member 5 with respect to the trigger 3 (relatively, movement to the outer side of the trigger 3 itself), and second regulating portions 18*a*, 18*b* for regulating the movement to the outer side (near side in plane of drawing) of the lock member 5 with respect to the trigger 3 (relatively, movement to the inner side of the trigger 3 itself) are formed on the trigger 3.

In the present embodiment, the lock member 5 can be attached to the trigger 3 in a swingable manner by elastically deforming to spread a spacing of the two distal end portions of the lock member 5.

Figure 10:
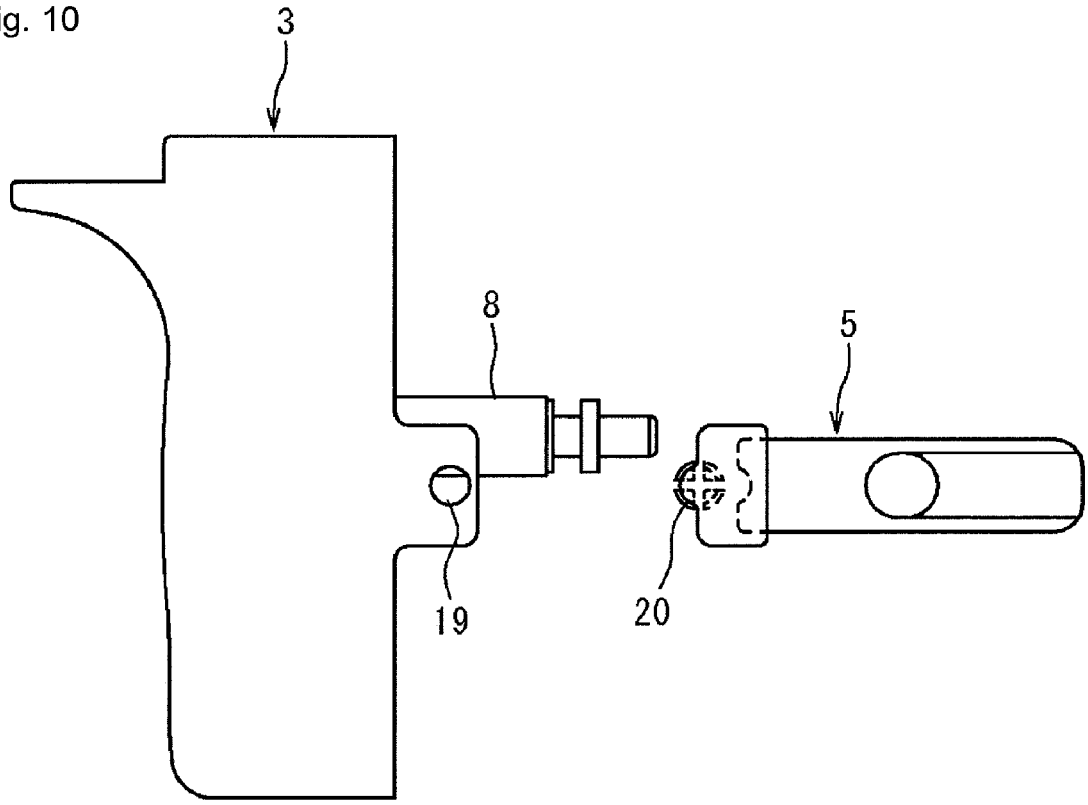
FIG. 10 is a partial side view of a trigger switch according to a fourth embodiment of the present invention.

FIG. 10 shows the trigger 3 and the lock member 5 of a trigger switch according to a fourth embodiment of the present invention. In the present embodiment, a circular engagement hole 19 is formed in the trigger 3, and an engagement projection 20 that fits to the engagement hole 19 with play is formed at the lock member 5.

Figure 11:
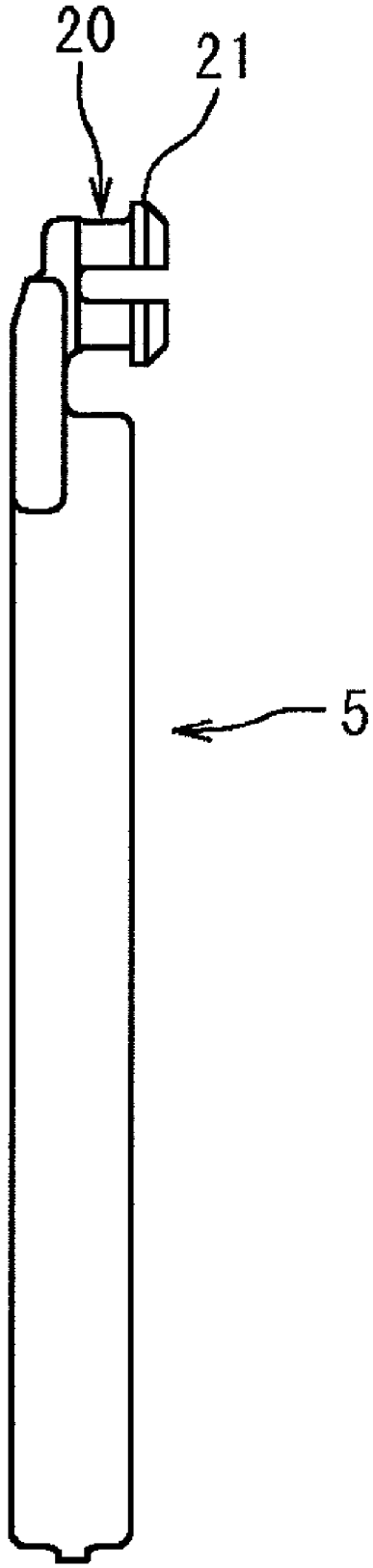
FIG. 11 is a plan view showing a lock member of the trigger switch in FIG. 10.

As shown in FIG. 11, the engagement projection 20 has a locking portion 21 at the distal end for preventing the projection 20 from coming out of the engagement hole 19, and is divided into four so that the locking portion 21 can be reduced in diameter and deformed to pass through the engagement hole 19.

Figure 12:
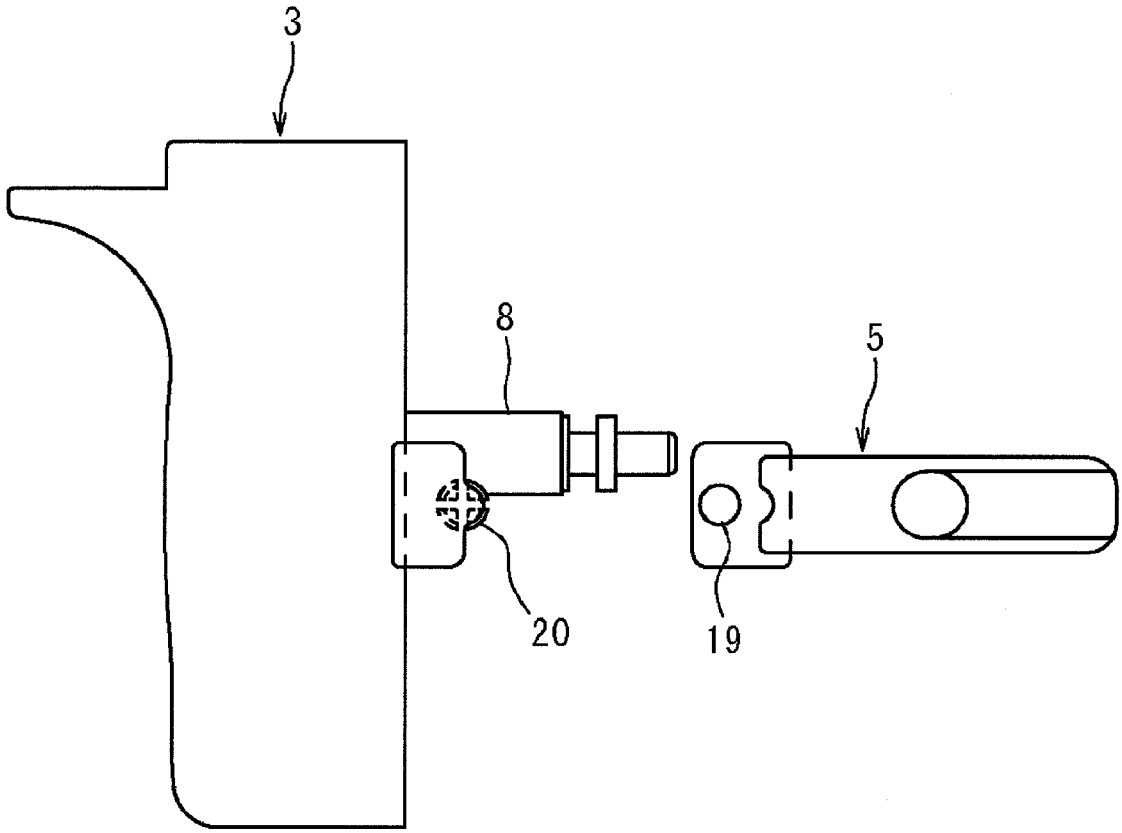
FIG. 12 is a partial side view of a trigger switch according to a fifth embodiment of the present invention.

FIG. 12 shows the trigger 3 and the lock member 5 of a trigger switch according to a fifth embodiment of the present invention. In the present embodiment, the engagement projection 20 is arranged on the trigger 3 and the engagement hole 19 is formed in the lock member 5, contrary to the fourth embodiment.

What is claimed is:

1. A trigger switch comprising:

a trigger arranged projected and biased to a front side in a housing; and a lock member projecting from a side of the trigger towards the housing, and being engaged with a lock button projecting to the side from the housing to fix the trigger in a pulled-in state;

wherein the lock member is swingably attached to the trigger, and wherein the lock member is multi-axial swingably supported to the trigger.

2. The trigger switch according to claim 1, wherein a swing of the lock member is enabled by play of connection of the lock member and the trigger.

3. The trigger switch according to claim 1, wherein a swing of the lock member is enabled by play of connection of the lock member and the trigger.

4. The trigger switch according to claim 1, wherein one of the lock member and the trigger has a pair of outward projections projecting in directions opposite to each other, and the other of the lock member and the trigger has a pair of inward projections projecting towards each other to engage the pair of outward projections from an outer side;

one of the lock member and the trigger has a first regulating portion for regulating a movement towards a side with respect to the other one of the lock member and the trigger; and one of the lock member and the trigger has a second regulating portion for regulating a movement in a relatively opposite direction to the movement regulated by the first regulating portion with respect to the other one of the lock member and the trigger.

5. The trigger switch according to claim 4, wherein the pair of projections is arranged in an up and down direction, a projection on an upper side of at least one of the pair of outward projections and the pair of inward projections being longer than a projection on a lower side.

6. The trigger switch according to claim 4, wherein the projection of at least one of the pair of outward projections or the pair of inward projections is inclined towards a near side.

7. The trigger switch according to claim 4, wherein the lock member is formed with the trigger side branched into two, the outward projection or the inward projection being formed at two distal ends of the branch.

8. The trigger switch according to claim 4, wherein one of the lock member and the trigger has both the first regulating portion and the second regulating portion.

9. The trigger switch according to claim 8, wherein the pair of projections is arranged in an up and down direction, a projection on an upper side of at least one of the pair of outward projections and the pair of inward projections being longer than a projection on a lower side.

10. The trigger switch according to claim 8, wherein the projection of at least one of the pair of outward projections or the pair of inward projections is inclined towards a near side.

11. The trigger switch according to claim 8, wherein the lock member is formed with the trigger side branched into two, the outward projection or the inward projection being formed at two distal ends of the branch.

12. The trigger switch according to claim 8, wherein positions of the first regulating portion and the second regulating portion are shifted in an extending direction of the lock member.

13. The trigger switch according to claim 12, wherein the pair of projections is arranged in an up and down direction, a projection on an upper side of at least one of the pair of outward projections and the pair of inward projections being longer than a projection on a lower side.

14. The trigger switch according to claim 12, wherein the projection of at least one of the pair of outward projections or the pair of inward projections is inclined towards a near side.

15. The trigger switch according to claim 12, wherein the lock member is formed with the trigger side branched into two, the outward projection or the inward projection being formed at two distal ends of the branch.

* * * * *